US010892120B2

(12) United States Patent
Bouvier et al.

(10) Patent No.: US 10,892,120 B2
(45) Date of Patent: Jan. 12, 2021

(54) ELECTRIC SWITCH OF THE NORMALLY OPEN TYPE

(71) Applicant: C&K COMPONENTS S.A.S., Dole (FR)

(72) Inventors: Laurent Bouvier, Monnieres (FR); Fabrice Valcher, Dole (FR); Rémi Martin, Rouvres-en-Plaine (FR); Thierry Burnel, Dole (FR); Laurent Kubat, Dole (FR)

(73) Assignee: C&K Components S.A.S., Dole (FR)

( * ) Notice: Subject to any disclaimer, the term of this patent is extended or adjusted under 35 U.S.C. 154(b) by 0 days.

(21) Appl. No.: 16/733,303

(22) Filed: Jan. 3, 2020

(65) Prior Publication Data

US 2020/0219682 A1 Jul. 9, 2020

(30) Foreign Application Priority Data

Jan. 4, 2019 (FR) ..... 19 00062

(51) Int. Cl.

| | |
|---|---|
| ***H01H 13/14*** | (2006.01) |
| ***H01H 1/58*** | (2006.01) |
| ***H01H 13/26*** | (2006.01) |
| ***H01H 13/52*** | (2006.01) |
| ***H01H 19/635*** | (2006.01) |

(52) U.S. Cl.

CPC ..... *H01H 13/14* (2013.01); *H01H 1/5805* (2013.01); *H01H 13/26* (2013.01); *H01H 13/52* (2013.01); *H01H 19/635* (2013.01); *H01H 2205/002* (2013.01)

(58) Field of Classification Search

CPC ..... H01H 13/14; H01H 1/5805; H01H 13/26; H01H 13/52; H01H 1/06; H01H 1/365

USPC ..... 200/238, 239, 241, 242, 245, 246, 250, 200/275

See application file for complete search history.

(56) References Cited

U.S. PATENT DOCUMENTS

| | | | | |
|---|---|---|---|---|
| 4,686,336 A | | 8/1987 | Sorenson | |
| 4,731,510 A | * | 3/1988 | Nourry | H01H 1/24 200/245 |
| 5,334,034 A | | 8/1994 | Reichardt et al. | |
| 2004/0154907 A1 | * | 8/2004 | Blossfeld | H01H 1/5805 200/11 R |

FOREIGN PATENT DOCUMENTS

| | | |
|---|---|---|
| JP | H05211021 A | 8/1993 |
| JP | H1050174 A | 2/1998 |

* cited by examiner

*Primary Examiner* — Nguyen Tran
*Assistant Examiner* — Iman Malakooti
(74) *Attorney, Agent, or Firm* — Fox Rothschild LLP

(57) ABSTRACT

An electric switch of the normally open type includes a body made of insulating material, an actuator that is moveable between a high rest position and a low active contact position, a first elastically deformable contact blade supported by the body, and a second elastically deformable contact blade supported by the body. A first contact section of the first contact blade extends above a second contact section of the second contact blade. The first and second contact sections are superposed and are vertically distanced from each other when the actuator is in high rest position, and are in mutual electrical contact when the actuator is in low position so as to establish an electrical switching path.

13 Claims, 11 Drawing Sheets

ELECTRIC SWITCH OF THE NORMALLY OPEN TYPE

CROSS-REFERENCE TO RELATED APPLICATIONS

This patent document claims priority under 35 U.S.C. § 119(1) to France Patent Application Number 1900062, filed Jan. 4, 2019.

BACKGROUND

This disclosure relates to an electric switch of the normally open type. In particular, this disclosure relates to an electric switch that may be used for medical applications, such as a switch that can to detect with accuracy and reliability a number of doses of medicine.

To accurately and reliably detect dosage activity, an electric switch must have different characteristics and performance qualities including very small dimensions, a very large overtravel, very low dimensional tolerances relating to the position of the point of electrical contact, a low actuation force, a high actuation frequency. Suitable switches are not presently available in the prior art.

For example, according to a design known in particular from Japan Patent Application Publication Numbers JPH05211021A (titled Push Switch, published Aug. 20, 1993) and JPH1050174 (titled U-Shaped Contact Spring Piece for Switch, published Feb. 20, 1998), the switch includes a pivoting actuator that supports a moveable contact blade, two free contact branches of which make electrical contact with fixed conductor tracks when the actuator is in active angular position. In such a design, the shape of the moveable contact blade and its installation in the actuator induce significant position tolerances of the free contact ends of the contact branches after installation and assembly. In addition, the design makes very large series production difficult.

A normally closed switch is also known from U.S. Pat. No. 4,686,336 to Sorenson, comprising a casing which defines an inner cavity; a push button which is moveably installed with respect to the casing; a fixed contact blade; a moveable contact blade which comprises a first part which is rigidly fixed in the casing and a second part which extends from the first part in a cantilever arrangement, in which, when a distal end of the second part of the moveable blade is in contact with the fixed blade, the moveable blade closes an electrical circuit; and at least one positive stop which cooperates with the fixed blade; in which switch, when a force is applied to the push button, the distal end of the second part of the moveable blade bends and moves in a first direction, then breaks the contact with the fixed blade, thus opening the electrical circuit; and in which, when the force is released, the distal end of the second part of the moveable blade moves in a second direction opposite the first direction, and comes into contact with the fixed blade, thus closing the circuit; and in which one or more of the positive stops applies/apply pressure and opposes/oppose the movement of the fixed blade in the second direction and thus maintains/maintain a predetermined position of the fixed terminal, but does/do not interfere with the moveable blade or does not/do not block it.

Similar designs of electrical switches with two blades, which are of the normally closed type, including one rigid fixed, or symmetrically of the normally closed type are also known from U.S. Patent Application Publication Number 2004/0154907 (Blossfeld et al.).

An electric switch is also known from U.S. Pat. No. 5,334,034 (Reichardt et al.) of the normally open type.

To address shortcomings of the prior art such as those described above, this document proposes an electric switch of this type which at the same time allows a low tolerance for the value of the closing travel of the switch, and a significant overtravel on actuation, while keeping the electrical circuit closed.

SUMMARY

In various aspects, this document discloses an electric switch of the normally open type including:

a body made of insulating material;

an actuator which is moveably installed with respect to the body between a high rest position in which the actuator abuts against a facing portion of the body, and a low active contact position;

a first contact blade supported by the body which is elastically deformable under the action of the actuator between:

a high rest position in which this first contact blade elastically abuts upwards against a facing portion of the actuator, the actuator being elastically returned to its high rest position by the first contact blade; and a low active contact position;

a second contact blade supported by the body which is elastically deformable downwards from a rest position in which it elastically abuts upwards directly against a facing portion of the body, or indirectly with interposition of a part of the actuator, electric switch in which:

a first contact section belonging to the first contact blade extends above a second contact section belonging to the second contact blade;

the first and second contact sections are superposed and are vertically distanced from each other when the actuator is in high position, and are in mutual electrical contact when the actuator is in low position so as to establish an electrical switching path;

the first and the second contact sections are arranged in parallel and in opposite directions.

the first and the second contact sections are arranged in parallel and in opposite directions, characterized in that the second contact section includes a central opening which is able to accommodate the first contact section.

According to other characteristics of the switch:

the actuator includes an active lower part which cooperates with the first contact blade and which is situated vertically in way of the first and second contact sections;

each contact blade includes a section for fastening the contact blade to the body, the section being extended by a contact section which, at rest, extends essentially horizontally;

each contact section extends longitudinally and is able to pivot around an essentially horizontal transversal axis;

the central opening is delimited by a transversal contact edge which cooperates with the first contact section when the first contact blade is in an active low contact position;

the first contact section includes a longitudinal rib which is formed to protrude downwards with respect to the plane of the underside of the first section and which is able to cooperate with said transversal contact edge of the central opening;

with the second contact blade in rest position, the active lower part of the actuator is situated longitudinally substantially in way of said transversal contact edge, and the second contact section abuts against a facing portion of the body in a zone which is situated longitudinally substantially in way of said transversal contact edge;

the actuator is a tilter installed to pivot with respect to the body around a horizontal axis;

the actuator is a push button installed to slide vertically with respect to the body;

the body includes a top cover forming a casing in which the two contact sections and the lower active part of the actuator are accommodated, and a bottom base plate on which the top cover is fastened;

the actuator includes an upper actuation part which protrudes out of the top cover;

the lower active part of the actuator is a transversal bulge delimited by a convex cylindrical outer surface whose axis is parallel to the axis of rotation of the actuation tilter;

the lower active part of the actuator cooperates with the first contact section belonging to the first contact blade.

BRIEF DESCRIPTION OF THE DRAWINGS

Other characteristics and advantages of the invention will emerge on reading the detailed description that will follow, for the understanding of which, reference will be made to the attached drawings, in which.

DETAILED DESCRIPTION

Figure 1:
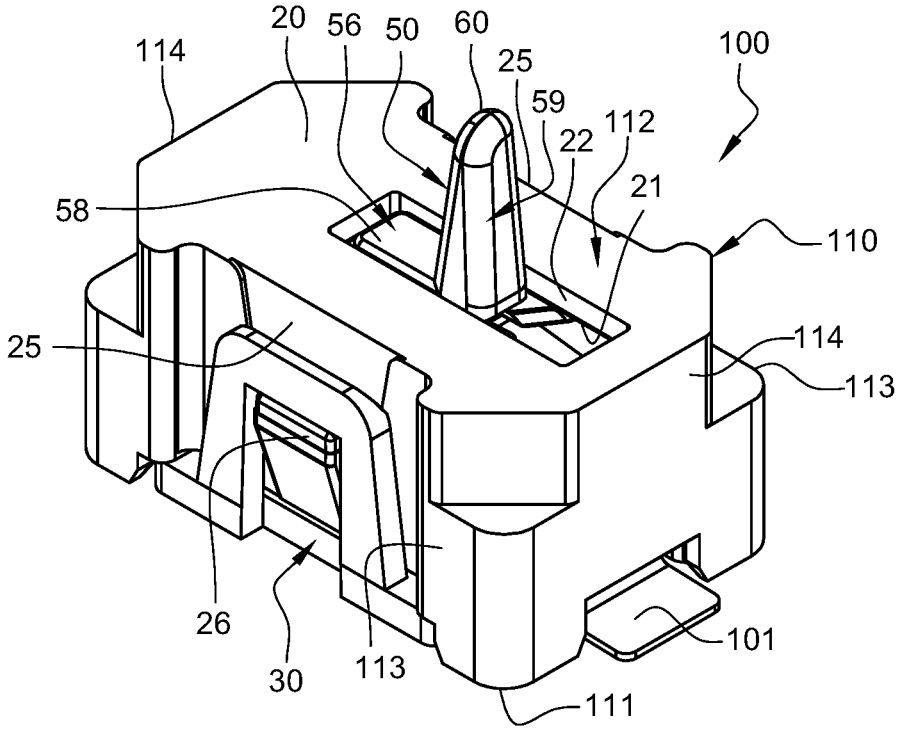
FIG. 1 is a perspective view which illustrates an embodiment of an electric switch on which the actuator is shown in the high rest position.

For the description of the invention and understanding the claims, the vertical, longitudinal and transversal orientations V, L, T indicated on the figures, whose longitudinal L and transversal T axes extend in a horizontal plane, will be adopted as non-limitative and without limitative reference to earth gravity.

By convention, the longitudinal axis L is oriented from the back to the front.

In the description that will follow, identical, similar or analogous elements will be designated by the same reference numbers.

In the description that will follow, each electric switch has a general symmetry of design with respect to the median vertical and longitudinal plane.

As used in this document, the singular forms "a," "an," and "the" include plural references unless the context clearly dictates otherwise. Unless defined otherwise, all technical and scientific terms used herein have the same meanings as commonly understood by one of ordinary skill in the art. As used in this document, the term "comprising" (or "comprises") means "including (or includes), but not limited to." When used in this document, the term "exemplary" is intended to mean "by way of example" and is not intended to indicate that a particular exemplary item is preferred or required.

In this document, the term "connected", when referring to two physical structures, means that the two physical structures touch each other. Devices that are connected may be secured to each other, or they may simply touch each other and not be secured.

In this document, the term "operably connected", when referring to two physical structures, means operation (i.e., movement) of one structure will cause the other structure to responsively move. Operably connected structures may be physically connected to each other, or they may be indirectly connected via one or more intermediate structures.

When used in this document, relative terms of position such as "up" and "down", "upper" and "lower", and "upward" and "downward" are not intended to have absolute orientations but are instead intended to describe relative positions of various components with respect to each other. For example, a first component may be an "upper" component and a second component may be a "lower" component when a device of which the components are a part is oriented in a first direction. The relative orientations of the components may be reversed, or the components may be on the same plane, if the orientation of the structure that contains the components is changed. The claims are intended to include all orientations of a device containing such components.

The electric switch 100 includes, arranged vertically from top to bottom, a top cover 110, an actuator 50, a first contact blade 70, a second contact blade 90, and a bottom base plate 30.

The top cover 110 and the bottom base plate 30 form the body of the electric switch 100.

The top cover 110 is a moulded piece of insulating plastic material which here is in the shape of a rectangular parallelepiped casing whose underside 111 is open and which includes a horizontal top wall 112, two opposite longitudinal side walls 113 and two opposite transversal side walls 114 which delimit an inner housing 115.

The inner side 116 of each longitudinal side wall 113 includes, at its top part, a central portion 117 in extra thickness which is longitudinally centred and which is delimited by a bottom horizontal edge 118.

Each portion 117 also includes, close to its rear longitudinal end, a semi-cylindrical housing 119 which is vertically open downwards.

The top wall 112 is delimited by a horizontal top side 20 and by a horizontal underside 21.

The top wall 112 includes a central opening 22 of rectangular contour.

At each opposite transversal end of each transversal side wall 114, the top cover 110 includes a vertical slot 23 for transversal orientation which is vertically open downwards, the slots 23 thus being transversally aligned in pairs.

The outer side 24 of each longitudinal side wall 113 includes a recess 25 fitted with a central locking tab 26 in relief.

The bottom base plate 30 is a moulded part of insulating plastic material, generally rectangular in shape which is vertically delimited by a horizontal top side 31 and a horizontal underside 32, and laterally by two longitudinal vertical edges 33 and two transversal vertical edges 34.

Each longitudinal edge 33 includes a sill 35 above which a hoop or lug 36 extends vertically, each of which cooperates with an associated locking tab 26 to ensure assembly of the two components 110 and 30 of the body of the electric switch 100.

Close to each transversal edge 34, the bottom base plate 30 includes a block 37, generally rectangular parallelepiped in shape, which extends vertically upwards above the top side 31 and which is delimited by an outer vertical transversal side 38.

The block 37 includes two longitudinal extensions 39, each of which supports a vertical post 40 delimited by a top horizontal facet 41.

Figure 9:
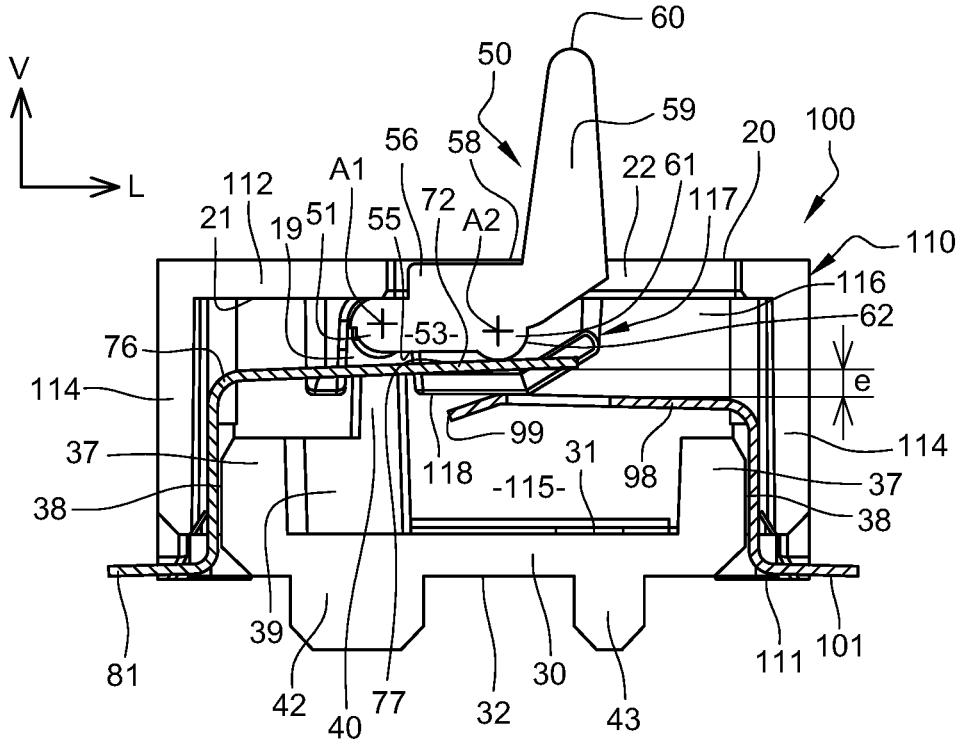
FIG. 9 is a front view of the electric switch of FIG. 7.
Figure 10:
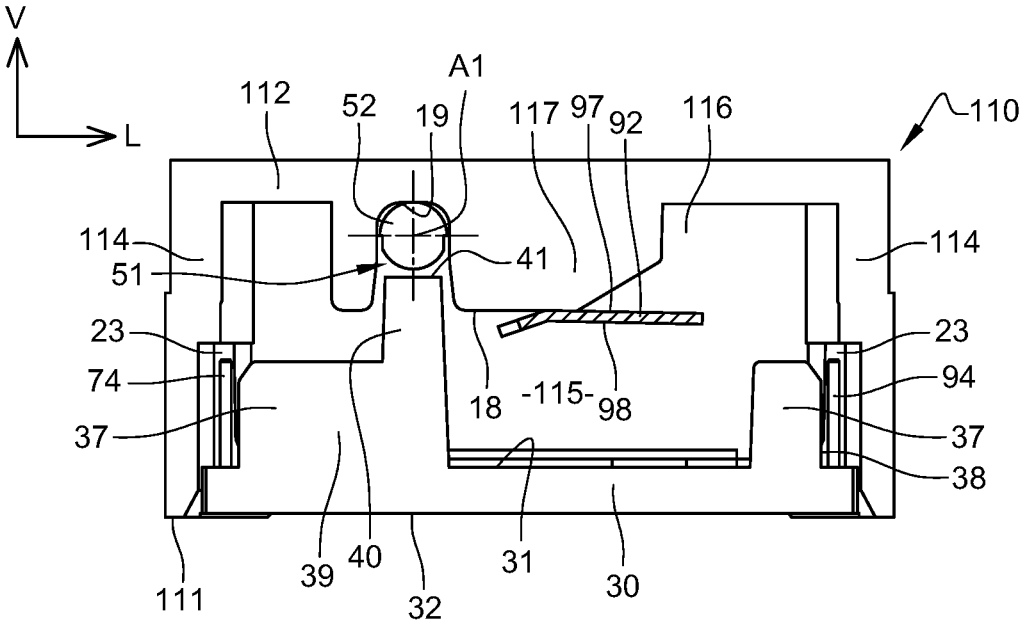
FIG. 10 is a sectional view of the electric switch of FIG. 1 along the line A3-A3 of FIG. 5.
Figure 11:
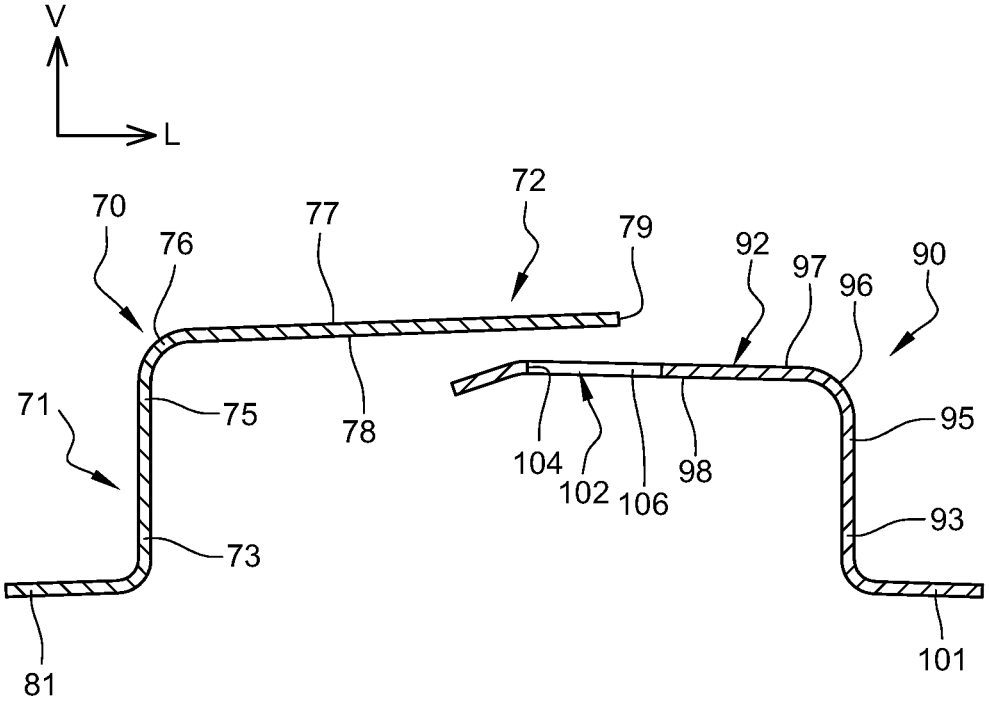
FIG. 11 is a sectional view through the median vertical and longitudinal plane of FIG. 5 of the two contact blades illustrated on FIG. 6.

As can be seen in particular on FIGS. 9 and 10, with the top cover 110 in assembled position on the bottom base plate 30, the top end of each vertical post 40 is accommodated in an associated housing 19.

Below its underside 32, the base plate 30 includes two pieces 42 and 43 for positioning and fool proofing the positioning of the electric switch 100, for example on a printed circuit board (not illustrated).

The actuator 50 is a moulded piece of insulating plastic material.

In the different embodiments illustrated on the figures, the actuator 50 is a tilter or tipper which is installed, at its rear end, to pivot with respect to the top cover 110 around a transversal and horizontal axis A1.

To that effect, the rear longitudinal part of the actuator 50 is configured as a shaft 51 which is terminated at each end by a cylindrical pin 52.

Each pin 52 is dimensioned such that it is accommodated with slight play in an associated semi-cylindrical housing 19 so as to be able to pivot there in both directions around the axis of rotation A1.

Each pin 52 is inserted vertically from bottom to top in the associated housing 19 and, with the top cover 110 in assembled position on the bottom base plate 30, the pin is held by the top facet 41 in its associated housing 19 facing the vertical post 40, (see FIG. 10).

The main front part of the actuator 50 is in the shape of a rectangular parallelepiped block 53 which is vertically delimited by a flat top side 54 and by a parallel flat underside 55.

Above its flat top side 54, the block 53 includes a central protruding slab 56, also rectangular parallelepiped in shape, which is transversally centred.

As can be seen in particular on FIGS. 1 and 9, the central slab 56 is dimensioned such that it can be accommodated, with slight play, in the central opening 22 of rectangular contour of the top wall 112.

Figure 7:
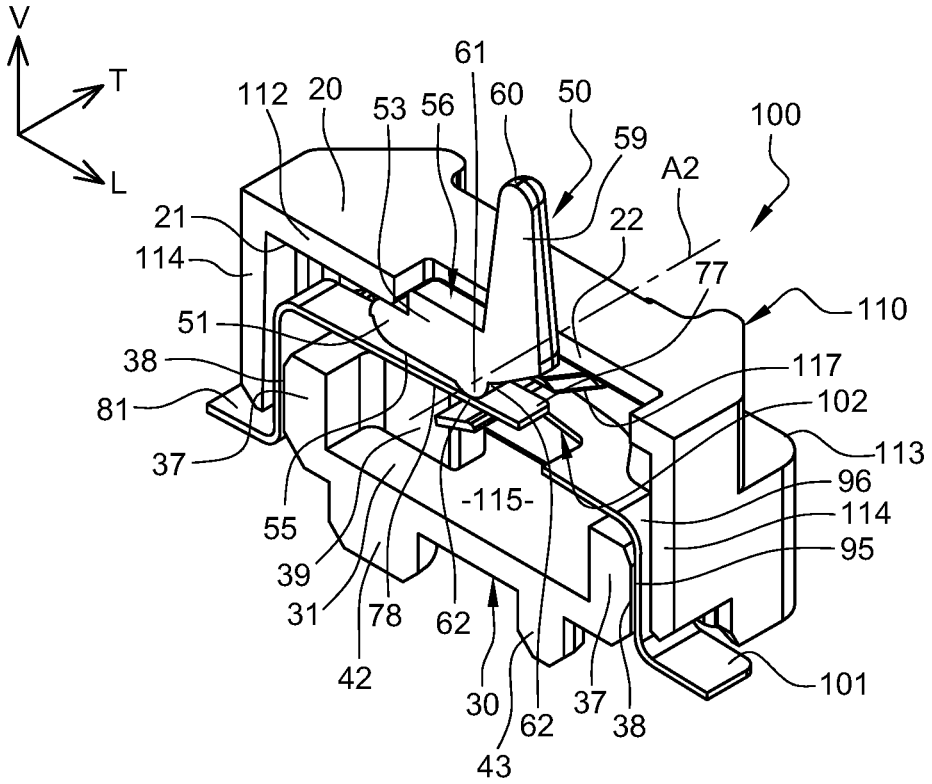
FIG. 7 is a half perspective view of the electric switch of FIG. 1 which is illustrated in section through the median vertical and longitudinal plane of FIG. 5.

This is the case in particular when the actuator is in its high rest position illustrated on FIGS. 1, 7 and 9 in which the side portions 57 of the top side 54 of the block 53 vertically abut upwards against facing portions of the horizontal underside 21 of the top wall 112 of the top cover 10.

In this rest position, the actuator 50 thus extends essentially horizontally forwards from the rear shaft 51.

Above its horizontal top side 58, the central slab 56 supports a top finger 59 which comprises the top part of the actuator 50, making it possible to act on the latter for the purpose of causing it to pivot around its axis of rotation A1, clockwise in consideration of FIG. 9.

With the actuator 50 in the top rest position, the top actuation finger 59 extends essentially vertically upwards above the horizontal top side 20 of the top wall 112.

Figure 2:
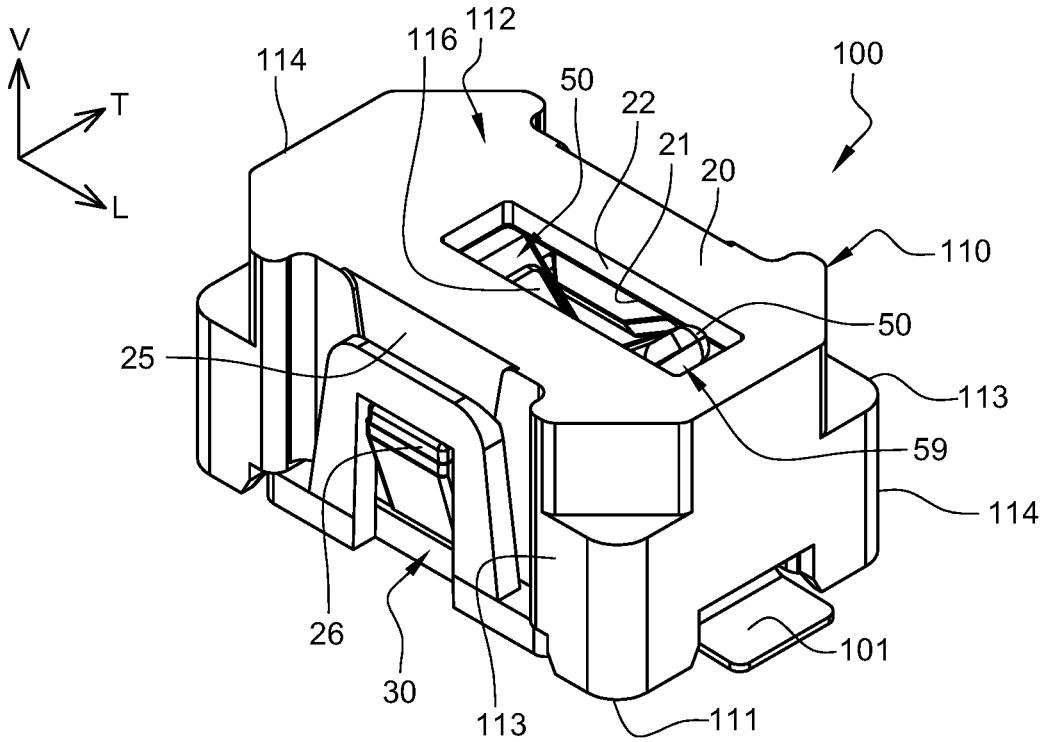
FIG. 2 is a view of the embodiment of FIG. 1, on which the actuator is shown in the maximum active low position.
Figure 8:
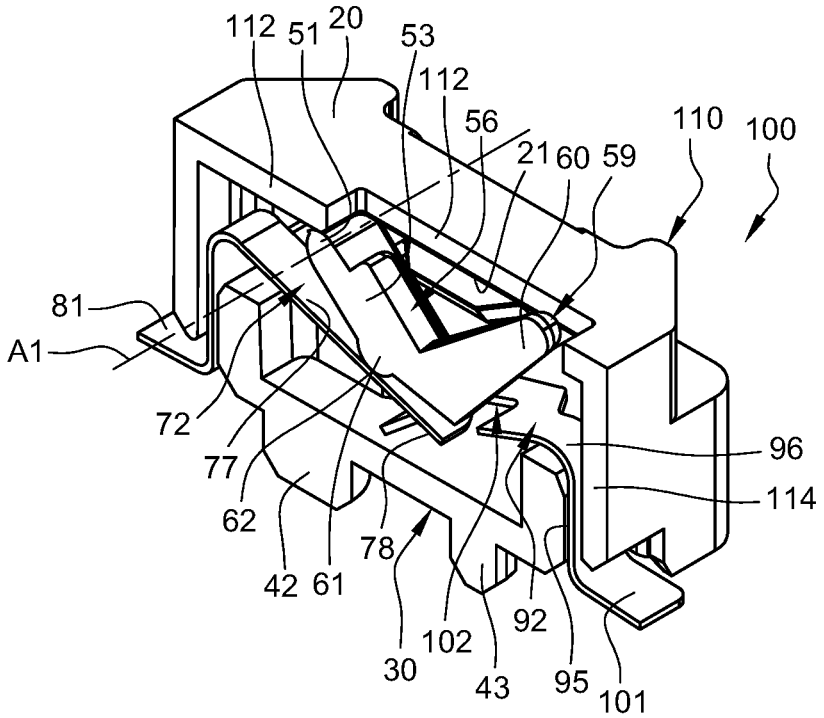
FIG. 8 is a view similar to that of FIG. 7 on which the actuator is shown in active low position.

As can be seen in particular on FIGS. 2 and 8, the actuator is able to pivot to a maximum "low" angular position in which the top finger 59 is fully retracted downwards such that its top free end edge 60 is flush with the plane of the top side 20 of the top wall 112.

At its front longitudinal end, the flat underside 55 of the block 53 includes a semi-cylindrical bulge 61 which extends over the entire transversal width of the block 53.

The transversal bulge 61 is delimited by a convex cylindrical outer surface 62 whose axis A2 is parallel to the axis of rotation A1 of the actuator 50.

So as to establish, or not, an electrical switching path, the electric switch 100 includes a first top contact blade 70 and a second bottom contact blade 90.

Each of the two contact blades is made of conducting material, for example of snipped and folded sheet metal.

The first contact blade 70 includes a first section 71 for fastening the first contact blade 70 to the body of the electric switch 100, the blade being extended by a first contact section 72 which, at rest, extends essentially horizontally.

The first fastener section 71 is in the shape of a fastener branch 73 of vertical and transversal orientation, each end of which is configured as a fastener plate 74, each of which is inserted vertically to be accommodated in an associated slot 23 adjacent to the rear transversal side wall 114 of the top cover 110.

Centrally, the fastener branch 73 is extended by a vertical connection branch 75.

The first contact section 72 extends longitudinally cantilevered forwards from the top end of the connection branch 75. It is connected to it by a substantially right angled bend 76.

The first contact section 72 of the first contact blade 70 is vertically delimited by a flat top side 77, by a flat contact underside 78, and by a forward free end transversal edge 79.

The first contact section 72 is also delimited by two opposite longitudinal edges 80.

As can be seen in particular by comparing FIGS. 11 and 12, or 7 and 8, the first contact blade 70 is able to deform elastically in the form of pivoting of the first contact section 72 at the connection bend 76, from a high rest position (FIGS. 7 and 11) to a low active contact position (FIGS. 8 and 12) around an essentially transversal and horizontal axis.

At its inner edge, the fastener branch 73 is extended horizontally rearwards by a horizontal plate 81 for electrical connection of the first contact blade 70.

With the first contact blade 70 inserted and installed in the top cover 10, the first contact section 72 elastically abuts upwards, through its top side 77, against a generatrix of the convex cylindrical side 62 of the transversal bulge 61 of the actuator 50.

The second contact blade 90 includes a second section 91 for fastening the second contact blade 90 to the body of the electric switch 100, the blade being extended by a second contact section 92 which, at rest, extends essentially horizontally.

The second fastener section 91 is in the shape of a fastener branch 93 of vertical and transversal orientation, each end of which is configured as a fastener plate 94, each of which is vertically inserted to be accommodated in a slot 23 adjacent to the front transversal side wall 114 of the top cover 110.

Centrally, the fastener branch 93 is extended by a vertical connection branch 95.

The second contact section 92 extends longitudinally cantilevered rearwards from the top end of the connection branch 95. It is connected to it by a substantially right angled bend 96.

The second contact section 92 of the second contact blade 90 is vertically delimited by a flat top side 97, by a flat underside 98, and by a rear free end transversal edge.

The second contact section 92 is also delimited by two opposite longitudinal edges 99.

As can be seen in particular by comparing FIGS. 11 and 12, or 7 and 8, the second contact blade 90 is able to deform elastically in the form of pivoting of the second contact section 92 at the connection bend 96, around an essentially transversal and horizontal axis.

At its lower edge, the fastener branch 93 is extended horizontally forwards by a horizontal plate 101 for electrical connection of the second contact blade 90.

The transversal width LT of the second contact section 92 which separates its two opposite longitudinal edges 99 is such that, in inserted and installed position in the top cover 110, it elastically abuts upwards, through its top side 97, on the two opposite sides, against the facing bottom edges 118 of the portions 117 in extra thickness.

As can also be seen on FIGS. 5 to 7 and 9 and 11, the two contact sections 72 and 92 are essentially arranged head to tail and vertically one above the other.

The second contact section 92 includes a central opening 102 which is able to accommodate the first contact section 72.

The central opening 102 is longitudinally delimited rearwards by a transversal contact edge 104, and transversally by two longitudinal and opposite inner edges 106.

The contact edge 104 is able to cooperate with the first contact section 72 when the second contact blade 90 reaches its active contact low position.

The inside transversal width of the opening 102 which separates its two opposite inner edges 106 is greater than the transversal width of the first contact section 72.

In rest position, and as can be seen in particular on FIG. 9, the dimensioning and installation of the first contact blade 70 are such that its first contact section 72 elastically stresses the actuator 50 by acting on the bulge 61, essentially vertically upwards.

The actuator 50 is thus elastically returned to its "high" angular rest position in which it vertically abuts upwards against the underside 21 of the top wall 112.

In this position, the side portions 57 of the top side 54 of the actuator 50 vertically abut upwards against the facing portions of the underside 21.

The first contact blade 70 thus acts as a spring for returning the actuator 50 to its rest position.

The geometric position of the first contact section 72 with respect to the top cover 110, and in particular its vertical elevation, is defined indirectly through the actuator 50 whose vertical elevation of the bulge 61 is defined in turn with respect to the top cover 110.

In rest position, and as can be seen in particular on FIG. 9, the dimensioning and installation of the second contact blade 90 are such that its second contact section 92 elastically abuts under load against the bottom edges 118 of the portions 117 in extra thickness of the top cover 110.

As can be seen in particular on FIG. 9, the second contact section abuts against the bottom edges 118 in a longitudinal zone which is situated substantially in way of the transversal contact edge and to the bottom active part 61, 62 of the actuator.

The geometric position of the second contact section 92 with respect to the top cover 110, and in particular its vertical elevation, is defined here directly with respect to the top cover 110.

In rest position, the design according to the invention thus makes it possible with very great accuracy to guarantee the relative vertical position of the first contact section 72 above the second contact section 92 with a perfectly controlled elevation or air gap "e" which only depends on the dimensions of the top cover 110 and the actuator 50 which are pieces of plastic material obtained by moulding.

The generatrix of the convex outer surface 62 of the bulge 61 abutting on the top side 77 of the first contact section 72 is substantially vertically aligned with the future line of electrical contact between the two contact sections 72 and 92.

The design and embodiment of the contact blades 70 and 90 and potential dimensional and shape variations thereof have virtually no influence on this relative positioning.

Actuation takes place by acting on the top finger 59 so as to cause the actuator to pivot around the axis A1, in a clockwise direction in consideration of FIG. 9, for the purpose of bringing it to its low active contact position.

During this actuation travel, the bulge 61 acts on the top side 77 of the first contact section 70 so as to cause it to pivot clockwise essentially at the bend 76.

The first contact section 72 is almost rigid and it pivots until a portion of its contact underside 78 makes electrical contact with the transversal contact edge 104 of the opening 102.

During this first part of the actuation travel, the second contact section 92 is fixed with respect to the first contact section 72. The travel until electrical contact has been established is thus constant and precise.

As soon as contact is made, the second contact section 92 starts to pivot around the bend 96 in an anticlockwise direction while ensuring high electrical contact pressure.

According to a variant, not illustrated, the first contact section 78 includes a longitudinal rib which is formed to protrude downwards with respect to the plane of the underside 78. Contact is thus made between the longitudinal summit of the rib and the transversal contact edge 104 by virtue of an almost punctual contact. This design of the first contact section 72 makes it possible further to increase the accuracy of the value of the actuation travel until electrical contact is established.

After electrical contact has been established, the angular actuation travel of the actuator 50 can be continued by thus allowing a significant overtravel.

Figure 3:
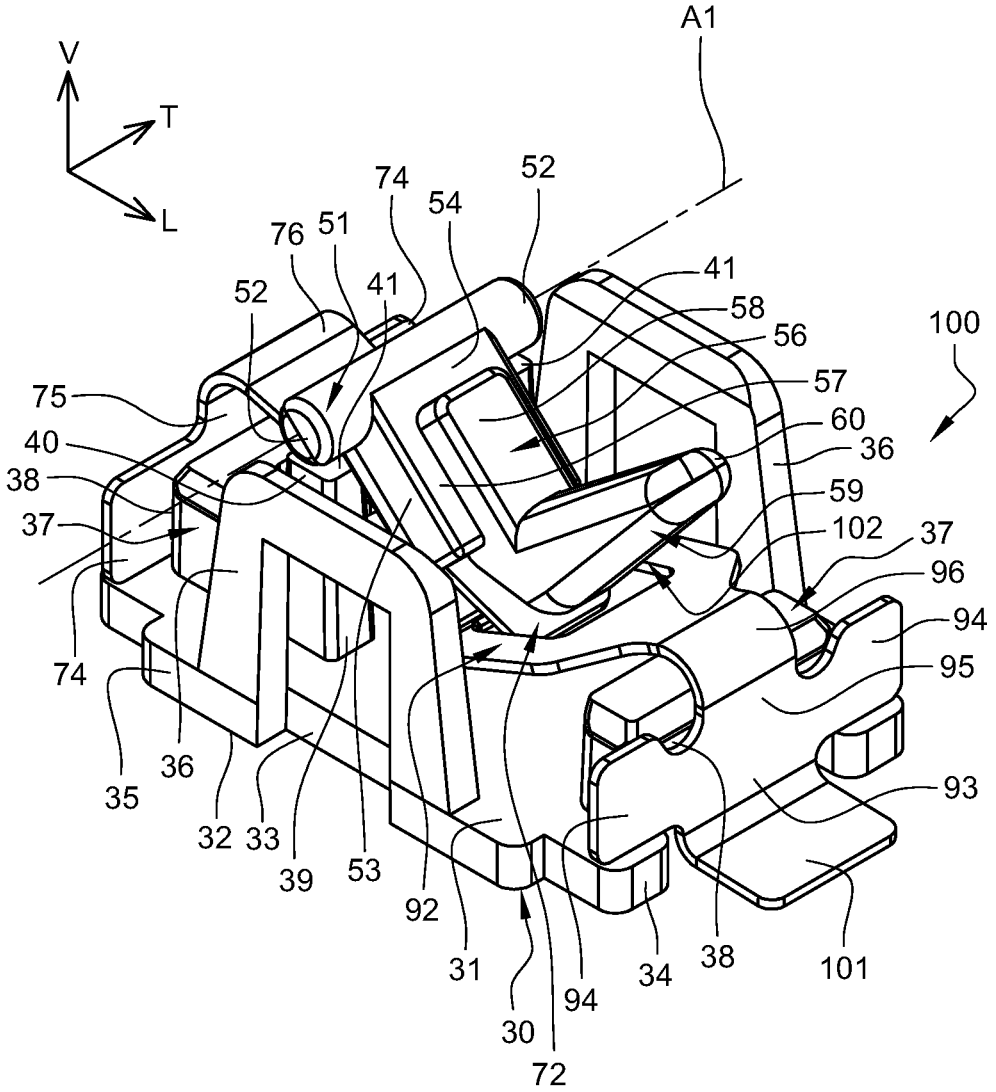
FIG. 3 is a view of the embodiment of FIG. 2, on which the switch is shown without its top cover forming a casing.
Figure 4:
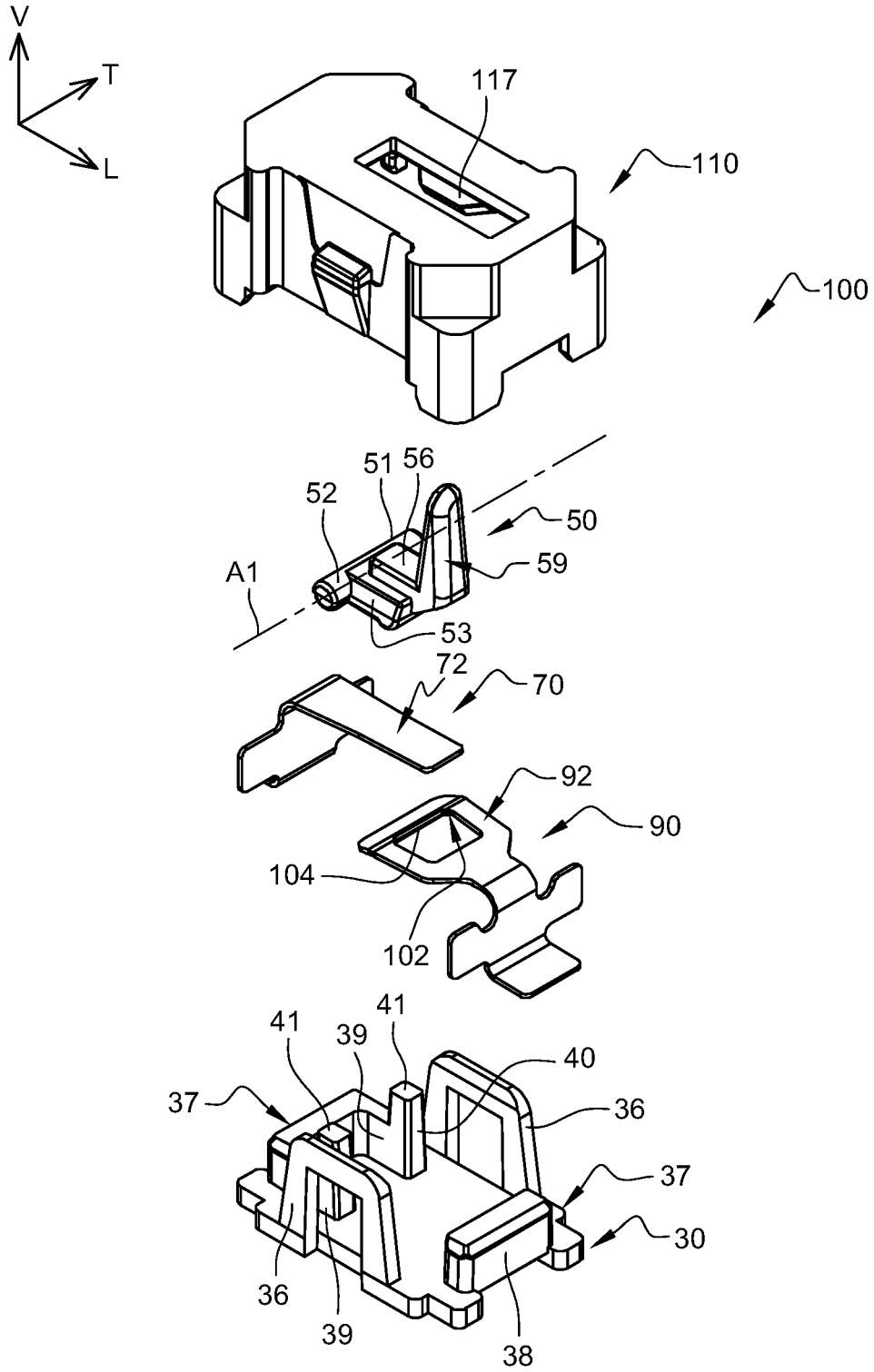
FIG. 4 is an exploded perspective view of the components of the electric switch of FIG. 1.
Figure 5:
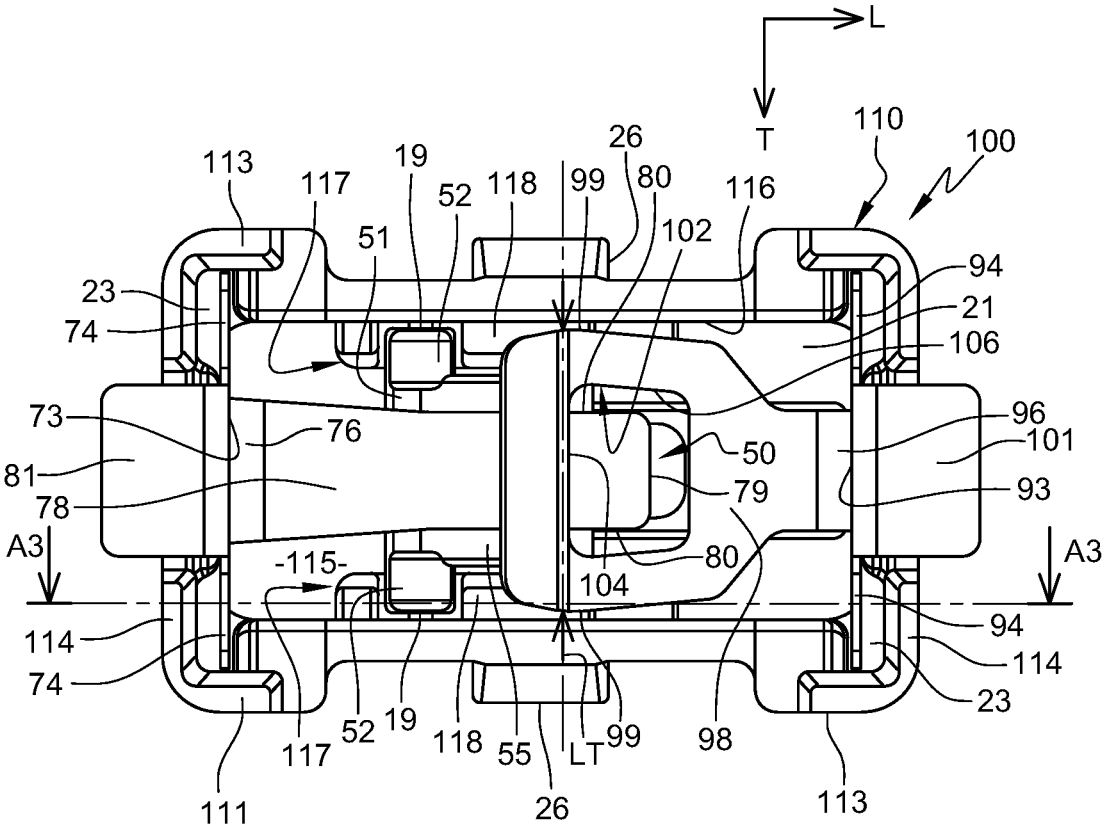
FIG. 5 is a top view of the electric switch of FIG. 1 which is illustrated without its bottom base plate.
Figure 6:
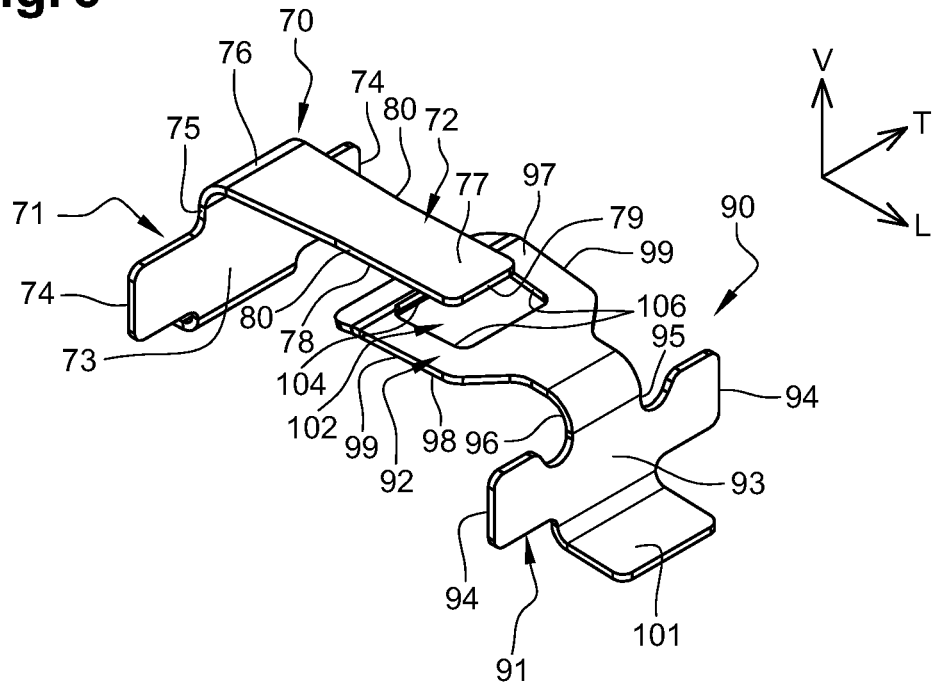
FIG. 6 is a perspective view of the two contact blades of the electric switch of FIG. 1.
Figure 12:
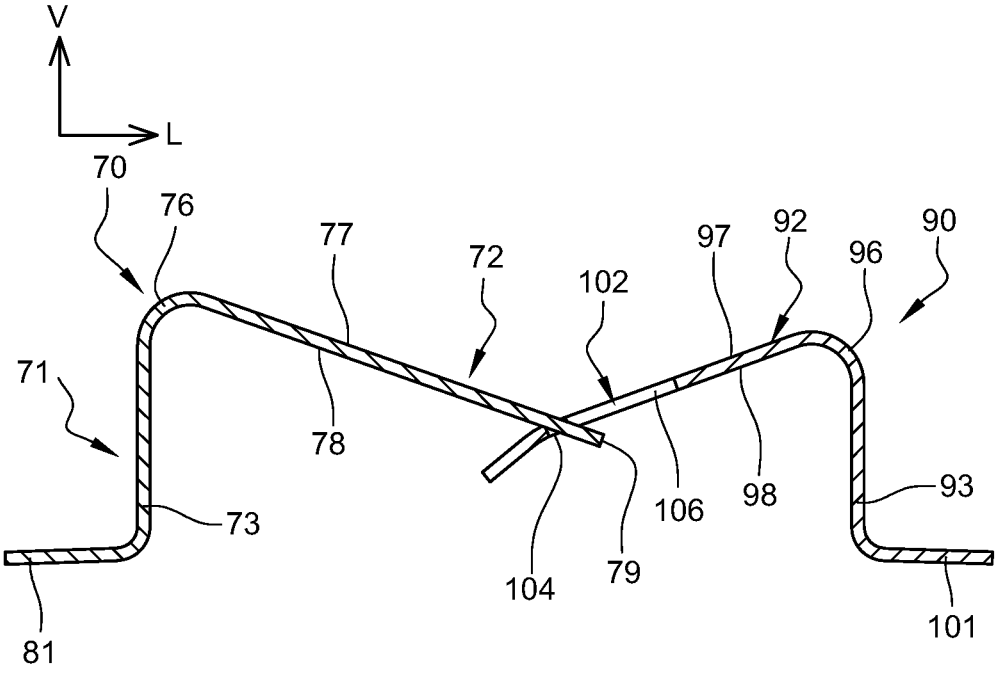
FIG. 12 is a view similar to that of FIG. 11 on which the two contact blades are shown in the position they occupy when the actuator is in its maximum active low position illustrated on FIGS. 3 and 8.

This is due to the design according to which the first contact section 72 is then accommodated in the opening 102 (see FIGS. 3, 8 and 12 in particular).

This additional part of the actuation travel down to its maximum low position takes place contrary to the initial elastic preloading force of the second contact section 92.

During this second part of the actuation travel, the line of contact between the transversal contact edge 104 and the underside 78 of the first contact section 72 moves slightly longitudinally forwards towards the free end edge 79, thus ensuring a "self-cleaning" effect of the electrical contact zone.

The maximum actuation travel illustrated on FIGS. 3, 8 and 12 corresponds here to full retraction of the top finger 59 of the actuator 50 into the top cover 110 with its top free end edge 60 flush with the plane of the top side 20 of the top wall 112.

As an example, the dimensions—length, width and height—of the body of the electric switch 100 may be 4.4 mm, 2.8 mm and 2.1 mm respectively with an actuation force less than or equal to 0.50 Newton (50 grams).

The design according to the invention, and in particular that of this first embodiment, is not limited to a pivoting actuator or tilter acting directly on the first contact section.

As a variant, the actuator can be a push button which is installed vertically moveable with respect to the top cover, with respect to which it is for example guided to blade.

In such a design, the actuation point of a bottom end of the push button acting on the top side of the first contact section only moves vertically.

It is possible to act directly on a top end of such a push button, or indirectly by means of a lever which is installed articulated on the top cover around an essentially horizontal axis which can have any orientation with respect to the transversal direction T.

Figure 13:
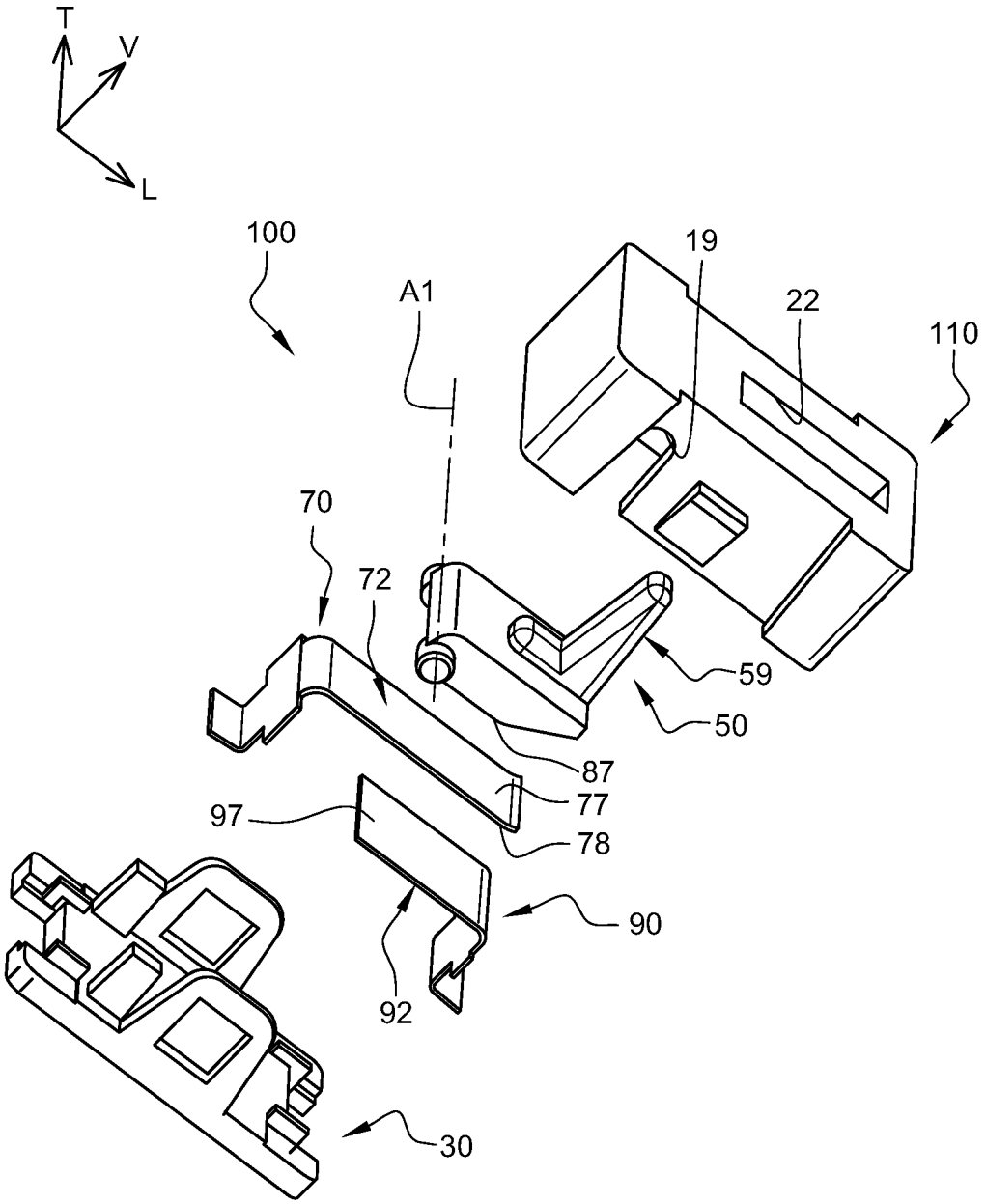
FIG. 13 is a view similar to that of FIG. 4 which illustrates an electric switch according to a second embodiment.
Figure 15:
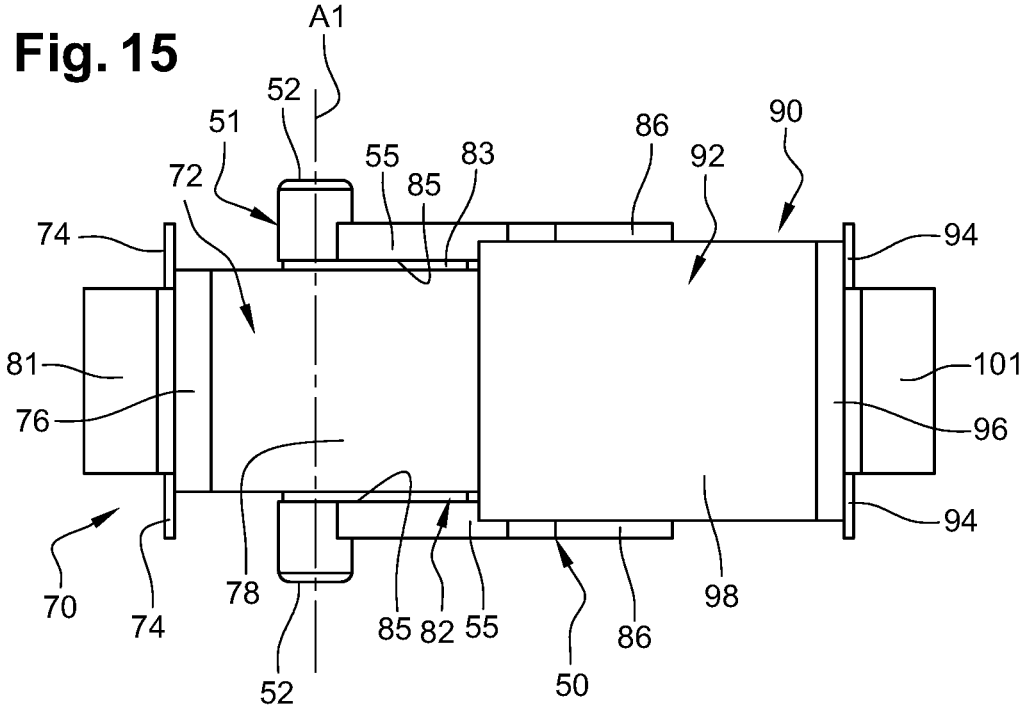
FIG. 15 is a top view of the two contact blades and the actuator of the electric switch according to the second embodiment of FIG. 13.

FIGS. 13 and 15 illustrate variations of the switch that result in a second embodiment. This second embodiment includes elements corresponding to those of the first embodiment, but differs essentially from the preceding one in that the second contact blade 90, through its second contact section 92, is elastically deformable downwards from its top rest position in which it elastically abuts upwards against a facing portion 21 of the top cover 110, indirectly with interposition of a part of the actuator 50.

Figure 14:
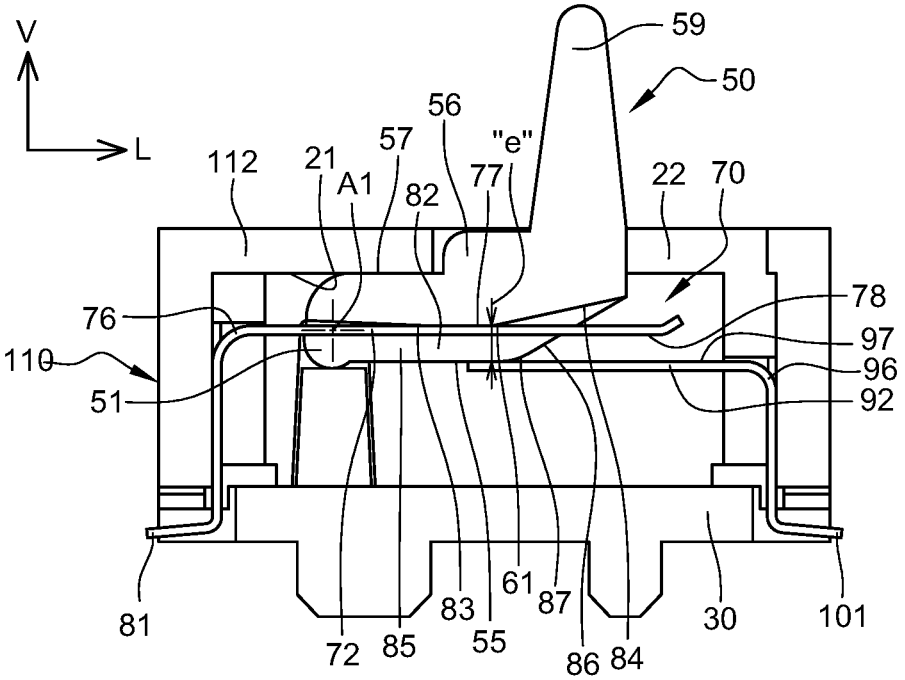
FIG. 14 is a view similar to that of FIG. 9 which illustrates the electric switch according to the second embodiment of FIG. 13.

The top part of the actuator 50 is configured as previously and, in its top rest position illustrated on FIG. 14, the side portions 57 of its top side 54 of the block 53 vertically abut upwards against facing portions of the horizontal underside 21 of the top wall 112 of the top cover 110.

In its underside 55, the block 53 includes a housing 82 which is delimited by a substantially horizontal rear underside 83 (in the rest position illustrated on FIG. 14) and by a front side 84 inclined upwards which forms an acute angle with respect to horizontal.

The two sides 83 and 84 are delimited between them by a ridge 61 of transversal orientation which acts in the same way as the bulge 61 and which comprises the active lower part 61 of the actuator 50, the ridge cooperating with the first contact section 72 of the first contact blade 70 and being situated vertically in way of the first and second contact sections 72, 92.

As can be seen on FIG. 15, the first contact section 72 is accommodated with transversal play between the two opposite longitudinal and horizontal edges 85 of the housing 82.

As soon as the actuator 50 starts its active travel by pivoting clockwise, the ridge 61 causes deformation of the first elastic blade 70 whose first contact section 72 pivots at the bend 76.

When the actuation force is released, the first contact blade 70 also functions as a spring for returning the actuator 50 to its rest position by acting on the ridge 61 through the top side 77 of the first contact section 72.

Transversally on either side of the housing 82, the underside 55 of the block 53 comprises two rear longitudinal and horizontal facets, each of which is extended longitudinally forwards by a front facet 86 which forms an acute angle with the rear facet 55.

They are longitudinally delimited with respect to each other by a transversal ridge 87.

The transversal orientation ridge 87 comprises an active lower part of the actuator 50 which cooperates with the second contact section 92 of the second contact blade 90, which is situated vertically in way of the first and second contact sections 72, 92 and which is substantially vertically aligned with the ridge 61.

As soon as the actuator 50 starts its active travel by pivoting clockwise, the ridge 87 causes deformation of the second elastic blade 90 and causes the second contact section 92 to pivot anticlockwise at the bend 96.

This elastic deformation takes place contrary to the elasticity of the second contact blade 90 which also contributes to the elastic return of the actuator to its rest position.

The clockwise pivoting of the actuator 50 from its rest position thus simultaneously causes elastic deformation of the two contact blades 70 and 90 and causes the two contact sections 72 and 92 to pivot in opposite directions.

The actuator 50 pivots on a first part of active travel until, close to its front free end, the underside 78 of the first contact section 72 makes electrical contact with a facing portion of the top side 97 of the second contact section 92.

After establishing the electrical contact, the angular actuation travel of the actuator 50 can be continued thus allowing overtravel.

This additional part of the actuation travel down to its maximum low position takes place contrary to the force applied to the actuator 50 by the two contact blades 70 and 90.

In rest position, this other design thus makes it possible to guarantee with accuracy the relative vertical position of the first contact section 72 above the second contact section 92 with an elevation or air gap "e" which depends on the dimensions of the actuator 50 and its rest position with respect to the top cover 110.

Figure 16:
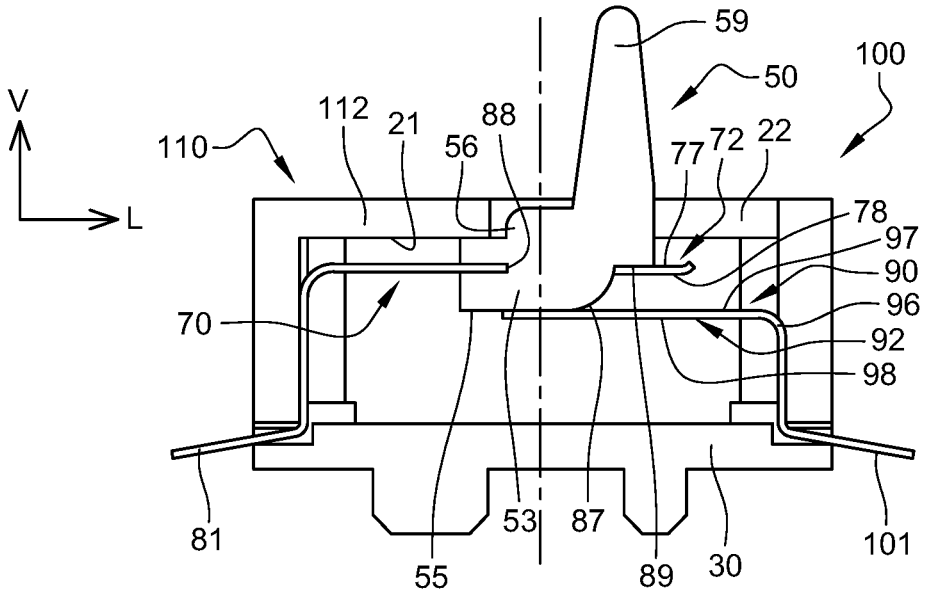
FIG. 16 is a view similar to those of FIGS. 9 and 14 which illustrates an electric switch according to a third embodiment.
Figure 17:
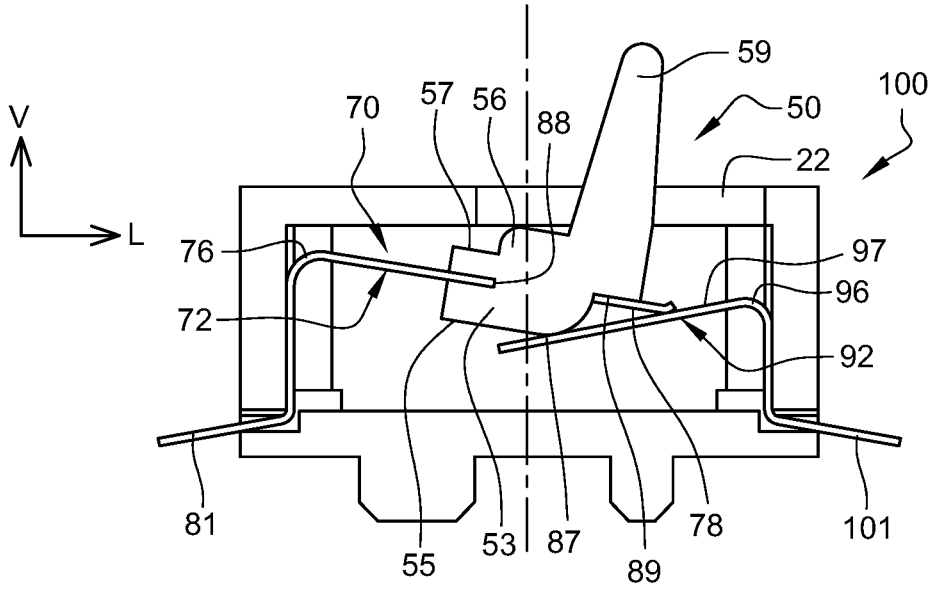
FIG. 17 is a view similar to that of FIG. 16 on which the actuator is shown in its maximum active low position.
Figure 18:
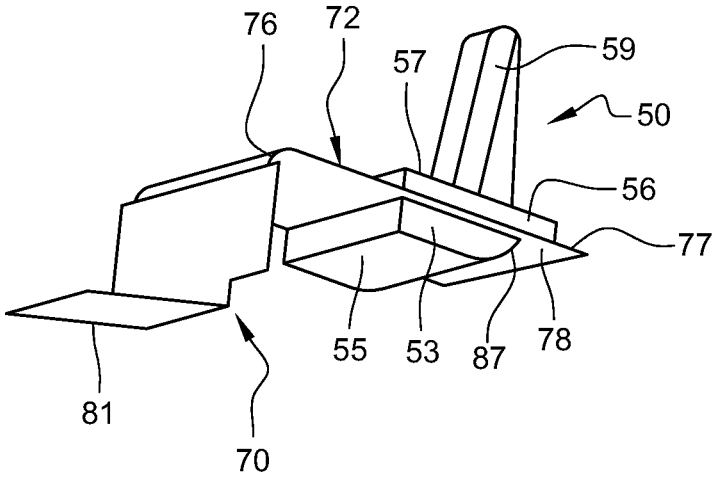
FIG. 18 is a perspective view which illustrates the actuator and the first contact blade according to the third embodiment.

FIGS. 16-18 illustrate a third embodiment that is similar to the preceding one in that the second contact blade 90, through its second contact section 92, elastically abuts upwards against a facing portion 21 of the top cover 110, indirectly with interposition of a part of the actuator 50

The top part of the actuator 50 is configured as previously, and in its high rest position illustrated on FIG. 1, the side portions 57 of its top side 54 of the block 53 vertically abut upwards against facing portions of the horizontal underside 21 of the top wall 112 of the top cover 110.

The body or block 53 of the actuator 50 here is over moulded on the first contact section 72 of the first contact blade 70 and the insulating plastic material it is comprised of extends through a central hole 88 formed in the first contact section 72.

In order to ensure a high degree of rigidity of the first contact section 72, the top side of the front end part of the latter abuts vertically upwards against a front lower horizontal facet 89 of the lower block.

According to this design, the first contact section 72 and the actuator 50 form a cohesive assembly.

From the high rest position illustrated on FIG. 16, an actuation force applied to the actuator 50 causes the actuator 50 to pivot.

Furthermore, the underside 55 of the lower block 53 of the actuator is configured as in the second embodiment with a transversal ridge 87.

As soon as the actuator 50 starts its active travel by pivoting clockwise, the ridge 87 causes deformation of the second elastic blade 90 and causes the second contact section 92 to pivot anticlockwise at the bend 96.

This elastic deformation takes place contrary to the elasticity of the second contact blade 90 which also contributes to the elastic return of the actuator 50 to its rest position.

The clockwise pivoting of the actuator 50 from its rest position thus simultaneously causes elastic deformation of the two contact blades 70 and 90 and causes the two contact sections 72 and 92 to pivot in opposite directions.

The actuator 50 pivots on a first part of active travel until, close to its front free end, the underside 78 of the first contact section 72 makes electrical contact with a facing portion of the top side 97 of the second contact section 92.

After establishing the electrical contact, the angular actuation travel of the actuator 50 can be continued thus allowing overtravel.

The features and functions described above, as well as alternatives, may be combined into many other different systems or applications. Various alternatives, modifications, variations or improvements may be made by those skilled in the art, each of which is also intended to be encompassed by the disclosed embodiments.

The invention claimed is:

1. An electric switch of a normally open type, including: a body made of insulating material; an actuator which is moveably installed with respect to the body between a high rest position in which the actuator abuts against a facing portion of the body, and a low active contact position; a first contact blade supported by the body which is elastically deformable when action of the actuator between: the high rest position in which the first contact blade elastically abuts upwards against a facing portion of the actuator, the actuator being elastically returned to its high rest position by the first contact blade, and the low active contact position; and a second contact blade supported by the body which is elastically deformable downwards from a rest position in which it elastically abuts upwards directly against the facing portion of the body, or indirectly with interposition of a part of the actuator, wherein: a first contact section belonging to the first contact blade extends above a second contact section belonging to the second contact blade, the first and second contact sections are superposed and are vertically distanced from each other when the actuator is in its high rest position, and are in mutual electrical contact when the actuator is in its low active contact position so as to establish an electrical switching path, the first and the second contact sections are arranged in parallel and in opposite directions, and the second contact section includes a central opening which is able to accommodate the first contact section.

2. An electric switch according to claim 1, wherein the actuator includes an active lower part which cooperates with the first contact blade and which is situated vertically in way of the first and second contact sections.

3. An electric switch according to claim 1, wherein each contact blade includes a section for fastening the contact blade to the body, the section being extended by a contact section which, at rest, extends essentially horizontally.

4. An electric switch according to claim 3, wherein each contact section extends longitudinally and is able to pivot around an essentially horizontal transversal axis.

5. An electric switch according to claim 1, wherein the central opening is delimited by a transversal contact edge which cooperates with the first contact section when the first contact blade is in its active low contact position.

6. An electric switch according to claim 1, wherein the first contact section includes a longitudinal rib which is formed to protrude downwards with respect to a plane of an underside of the first section and which is able to cooperate with a transversal contact edge of the central opening.

7. An electric switch according to claim 1, wherein: the actuator includes an active lower part which cooperates with the first contact blade and which is situated vertically in way of the first and second contact sections; the central opening is delimited by a transversal contact edge which cooperates with the first contact section when the first contact blade is in its active low contact position; and when the second contact blade is in its rest position, the active lower part of the actuator is situated longitudinally substantially in way of the transversal contact edge, and in that the second contact section abuts against the facing portion of the body in a zone which is situated longitudinally substantially in way of the transversal contact edge.

8. An electric switch according to claim 1, wherein the actuator comprises a tilter installed to pivot with respect to the body around a horizontal axis.

9. An electric switch according to claim 1, wherein the actuator comprises a push button installed to slide vertically with respect to the body.

10. An electric switch according to claim 2, wherein the body includes a top cover forming a casing in which the two contact sections and the lower active part of the actuator are accommodated, and a bottom base plate on which the top cover is fastened.

11. An electric switch according to claim 8, wherein the actuator includes an upper actuation part which protrudes out of the top cover.

12. An electric switch according to claim 7, wherein the lower active part of the actuator is a transversal bulge delimited by a convex cylindrical outer surface whose axis is parallel to an axis of rotation of the actuation tilter.

13. An electric switch according to claim 2, wherein the lower active part of the actuator cooperates with the first contact section belonging to the first contact blade.

* * * * *